US010254018B2

(12) United States Patent
Nickl

(10) Patent No.: US 10,254,018 B2
(45) Date of Patent: Apr. 9, 2019

(54) APPARATUS AND METHOD FOR CARRYING OUT A VAPOUR REFRIGERATION PROCESS

(71) Applicant: BITZER Kuehlmaschinenbau GmbH, Sindelfingen (DE)

(72) Inventor: Joerg Nickl, Malter (DE)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 0 days.

(21) Appl. No.: 15/884,595

(22) Filed: Jan. 31, 2018

(65) Prior Publication Data

US 2018/0149391 A1 May 31, 2018

Related U.S. Application Data

(63) Continuation of application No. PCT/EP2016/068126, filed on Jul. 29, 2016.

(30) Foreign Application Priority Data

Jul. 31, 2015 (DE) ..... 10 2015 214 705

(51) Int. Cl.
*F25B 9/06* (2006.01)
*F25B 9/00* (2006.01)
(Continued)

(52) U.S. Cl.
CPC ..... *F25B 9/06* (2013.01); *F25B 9/008* (2013.01); *F25B 11/02* (2013.01); *F25B 31/026* (2013.01);
(Continued)

(58) Field of Classification Search
CPC ..... F25B 2400/13; F25B 5/02; F25B 2400/06
See application file for complete search history.

(56) References Cited

U.S. PATENT DOCUMENTS 6,321,564 B1 11/2001 Yamanaka et al.
6,543,238 B2 4/2003 Yamanaka et al.
(Continued)

FOREIGN PATENT DOCUMENTS

DE 10010864 A1 9/2000
DE 10242271 B3 1/2004
(Continued)

*Primary Examiner* — Cassey D Bauer
(74) *Attorney, Agent, or Firm* — Reinhart Boerner Van Deuren P.C.

(57) ABSTRACT

The present invention relates to an apparatus and to a method for carrying out a vapour refrigeration process. The apparatus has a motor-operated main compressor which is equipped to suck-in a mass flow of a fluid serving as a refrigerant which is at evaporating pressure level and to compress this mass flow to a high pressure level, and also a high-pressure heat exchanger which is equipped to cool the mass flow of the fluid at a high pressure level, to increase a density and to reduce a temperature of the fluid. Also provided is an expander which is equipped to expand the mass flow of the fluid coming from the high pressure heat exchanger to evaporating pressure level in work-performing manner, and an evaporator which is equipped to absorb heat such that the density of the fluid decreases as it passes through the evaporator and the temperature of the mass flow coming from the expander at evaporating pressure and the temperature of the fluid being fed through the evaporator increase. Finally, there is a sub-cooler which is connected downstream of the high-pressure heat exchanger and upstream of the expander, wherein, downstream of the sub-cooler and upstream of the expander, part of the fluid is divertible from the mass flow and expandable by means of a high-pressure regulating valve to an intermediate pressure level so that the fluid which is then at the intermediate pressure level absorbs heat in a counter-flow arrangement in the sub-cooler and thereby additionally sub-cools the mass
(Continued)

flow at high pressure level, and also a high-pressure compressor which is mechanically directly connected to the expander and is equipped to compress, to the high-pressure level, only that part of the fluid that is diverted upstream of the expander and is being fed in counter-flow in the sub-cooler, and to mix this fluid, upstream of the high-pressure heat exchanger, with the mass flow coming from the motor-operated main compressor.

11 Claims, 5 Drawing Sheets

(51) Int. Cl.

| | |
|---|---|
| ***F25B 11/02*** | (2006.01) |
| ***F25B 31/02*** | (2006.01) |
| ***F25B 40/02*** | (2006.01) |
| ***F25B 43/00*** | (2006.01) |

(52) U.S. Cl.
CPC ..... *F25B 40/02* (2013.01); *F25B 43/006* (2013.01); *F25B 2400/06* (2013.01); *F25B 2400/13* (2013.01); *F25B 2400/23* (2013.01)

(56) References Cited

U.S. PATENT DOCUMENTS

| | | | | |
|---|---|---|---|---|
| 2006/0191288 | A1 | 8/2006 | Radermacher et al. | |
| 2008/0245505 | A1 | 10/2008 | Yamaguchi et al. | |
| 2010/0005831 | A1 | 1/2010 | Vaisman et al. | |
| 2015/0007598 | A1* | 1/2015 | Choi ..... | F25B 49/02 62/117 |

FOREIGN PATENT DOCUMENTS

| | | | |
|---|---|---|---|
| EP | 0787891 | A2 | 8/1997 |
| EP | 1812759 | B1 | 11/2009 |
| EP | 2896912 | A1 | 7/2015 |
| WO | WO 2008/079128 | A1 | 7/2008 |

* cited by examiner

APPARATUS AND METHOD FOR CARRYING OUT A VAPOUR REFRIGERATION PROCESS

CROSS-REFERENCE TO RELATED PATENT APPLICATIONS

This application is a continuation of International application number PCT/EP2016/068126 filed on Jul. 29, 2016.

This patent application claims the benefit of International application No. PCT/EP2016/068126 filed on Jul. 29, 2016 and German application No. 10 2015 214 705.3 of Jul. 31, 2015, the teachings and disclosure of which are hereby incorporated in their entirety by reference thereto.

BACKGROUND OF THE INVENTION

The present invention relates to an apparatus and a method for carrying out a vapour refrigeration process.

Vapour refrigeration processes using carbon dioxide as a refrigerant are known and, in the light of the greenhouse effect, are being used to an ever increasing extent due to the favourable properties of carbon dioxide. Improving the performance figures of a $CO_2$-vapour refrigeration process of this type by using a work-performing expansion process is known from the specification EP 1 812 759 B1 for example. However, a disadvantage of this known solution is that a complicated frequency controlling process is used for influencing the high pressure. Moreover, a so-called hydraulic pressure intensifier is known from Quack, H.; Kraus, W. E.: Carbon Dioxide as a Refrigerant for Railway Refrigeration and Air Conditioning, Proceedings of the IIR Conference New Application of Natural Working Fluids in Refrigeration and Air Conditioning, Hannover, Germany 1994, P. 489-494.

Consequently, the object of the present invention is to propose an apparatus and a method for carrying out a vapour refrigeration process with which simplified control and regulation of the vapour refrigeration process is possible.

SUMMARY OF THE INVENTION

An apparatus for carrying out a vapour refrigeration process comprises a motor-operated main compressor which is equipped to suck in a mass flow of a fluid which is serving as a refrigerant and is at evaporating pressure level and to compress this mass flow to a high pressure level. Moreover, there is provided a high pressure heat exchanger in order to cool the mass flow of the fluid that is at the high pressure level, to increase the density thereof and to reduce a temperature of the fluid due to the cooling process. The mass flow of the fluid coming from the high pressure heat exchanger is expanded in an expander in work-performing manner to the evaporating pressure level and supplied to an evaporator. The evaporator is equipped to absorb heat so that the density of the fluid when going through the evaporator decreases and the temperature of the mass flow at evaporating pressure level that is coming from the expander and being fed through the evaporator increases. Finally, there is provided a sub-cooler which is connected downstream of the high pressure heat exchanger and upstream of the expander. A part of the mass flow of the fluid which is at a high pressure level is divertible after the sub-cooler and before the expander and is expandable by means of a high pressure regulating valve to an intermediate pressure level so that the fluid which is then at intermediate pressure level absorbs heat in a counter-flow arrangement in the sub-cooler and thereby subcools the mass flow which is at the high pressure level in the sub-cooler. A high pressure compressor which is mechanically connected directly to the expander and is equipped such as to compress from intermediate pressure level to high pressure level exclusively the mass flow which was branched off between the sub-cooler and before the expander and is being fed in counter-flow to the mass flow of the fluid which is at the high pressure level and to mix it with the mass flow coming from the motor-operated main compressor before the high pressure heat exchanger.

Due to the apparatus described, it is possible to efficiently regulate the high pressure which is typically present on the high pressure heat exchanger, the high pressure compressor and partly on the sub-cooler. Due to the fact that the high pressure compressor which is additionally driven directly by the expander only compresses a separate mass flow of the fluid, the intermediate pressure mass flow, the mass flow which is being fed through the expander and comes from the high pressure heat exchanger can be additionally subcooled. The energy of the expansion process is thus used in the long run for additional subcooling at high pressure or the power of the expander serves to compress the intermediate pressure mass flow in the high pressure compressor.

An accumulator can be arranged after the expander (and thus before the evaporator). This is equipped such as to separate a liquid phase of the fluid and a vapour phase of the fluid. The liquid phase of the fluid is storable in the accumulator and is also expandable to the pressure of evaporation by an injector valve arranged between the accumulator and the evaporator. The vapour phase of the fluid is expansible by a pressure retaining valve. The expanded liquid phase is arranged to be fed to the evaporator in the mass flow, whilst the expanded vapour phase is mixable, after the evaporator, into the mass flow of the fluid coming from the evaporator.

Provision may be made for the expander and the high pressure compressor to be arranged in a common housing and to form a unit which is also referred to as an "expander-compressor unit". A space-saving design is made possible by the arrangement in a single housing, wherein the expander and the high pressure compressor are mechanically connectable directly to one another, in particular, in pressure tight manner.

The piston displacement ratio between the expander and the high pressure compressor should preferably lie between 0.5 and 0.75 in order to ensure optimal running of the vapour refrigeration process. It is particularly preferred that the piston displacement ratio amount to 0.6. In principle, it is advisable to utilise lower values for high re-cooling temperatures at the outlet of the high pressure heat exchanger.

As an alternative or in addition thereto, the work spaces of the expander can be controllable by a main slide valve and an auxiliary slide valve. Hereby, the main slide valve and the auxiliary slide valve are arranged centrally between the usually internally located, i.e. mutually facing, work spaces of the expander.

Preferably the main slide valve and/or or the auxiliary slide valve are implemented in the form of flat slide valves in order to ensure simple and in particular sealed functioning whilst only requiring a small amount of space.

Provision can also be made for the auxiliary slide valve to be movable by the working pistons by means of two pins.

Typically, a piston rod which holds the working pistons apart is connected to the working pistons in releasable manner i.e. it is not fixedly connected to them. This is technically simple and nevertheless functional since the inwardly located piston rod only experiences thrust forces and thus does not have to be fixedly connected to the piston or the pistons. Thereby, small misalignments can be accommodated by the housing parts and the manufacturing process is facilitated. A main slide valve unit consisting of the main slide valve, a slide valve rod and a slide valve piston can also be constructed in a similar manner. Likewise, an auxiliary slide valve unit consisting of the auxiliary slide valve and the pins can also be constructed in the same way.

Provision may be made for the expander to be implemented with multiple stages by which it is also to be understood in particular as meaning a plurality of expanders connected one behind the other which carry out an expansion process in several stages, for which purpose an older design in accord with DE 102 42 271 B3 without a frequency control system is suitable.

In the apparatus described, there may be four pressure levels which typically adopt the ranges described in the following: a high pressure level of between 50 bar and 100 bar, an intermediate pressure level of between 40 bar and 65 bar, an accumulator pressure level of between 30 bar and 35 bar and also an evaporating pressure level of between 25 bar and 30 bar.

A method for carrying out a vapour refrigeration process comprises a process step in which a mass flow of a fluid which is at evaporating pressure level and is serving as a refrigerant is compressed to a high pressure level by a motor-operated main compressor. This mass flow of the fluid which is at a high pressure level is cooled in a high pressure heat exchanger, whereby the density of the fluid is increased and the temperature of the fluid is reduced. The fluid coming from the high pressure heat exchanger is expanded in an expander in work-performing manner to an evaporating pressure level, wherein the expander is mechanically connected directly to a high pressure compressor. The fluid coming from the expander is fed into an evaporator where it absorbs heat so that the density of the fluid decreases and the temperature of the mass flow of the fluid coming from the expander which is at evaporating pressure level increases. After the high pressure heat exchanger and before the expander, the fluid is fed through a sub-cooler, whereby a part of the fluid is branched off from the mass flow at the high pressure level between the sub-cooler and before the expander and is also expanded to an intermediate pressure level by means of a high pressure regulating valve. Thereafter, the fluid is fed at intermediate pressure level through the sub-cooler in counter-flow to the mass flow which is at the high pressure level and is being fed through the sub-cooler, whereby it absorbs heat and the mass flow which is at the high pressure level is subcooled. After passing through the sub-cooler, the fluid in the branched off intermediate pressure mass flow arrives at the high pressure compressor which compresses exclusively the fluid that is being fed in the counter-flow arrangement from the intermediate pressure level to the high pressure level and, before the high pressure heat exchanger, mixes it with the mass flow coming from the motor-operated main compressor.

Provision may be made for the fluid to be fed after the expander into an accumulator in which a liquid phase of the fluid is separated from a vapour phase of the fluid. The liquid phase is expanded by an injector valve to the pressure of evaporation. The vapour phase of the fluid is expanded by a pressure retaining valve and, after the evaporator, is mixed into the mass flow of the fluid coming from the evaporator.

Carbon dioxide $CO_2$ can be used as the fluid which is also referred to in this context as a refrigerant, since carbon dioxide is not explosive and not combustible but rather, is thermally stable. Adding to its advantages as a cold carrier, it has a very low specific volume and a high heat transfer coefficient as well as low pressure losses when flowing through heat exchangers.

The method described can be carried out by the apparatus described or the apparatus described is equipped for carrying out the method described.

Exemplary embodiments of the invention are illustrated in the drawings and explained in the following with the aid of FIGS. 1 to 12.

DETAILED DESCRIPTION OF THE INVENTION

Figure 1:
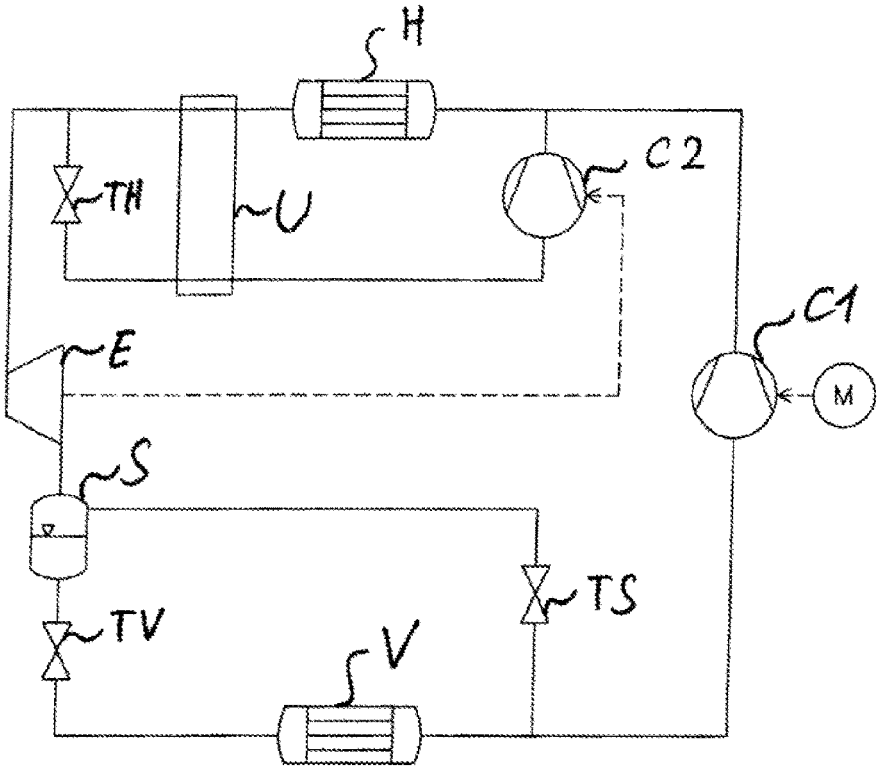
FIG. 1 a schematic illustration of a processing system for a vapour refrigeration process and FIG. 2 a schematic view corresponding to FIG. 1 of the processing system without an accumulator.

FIG. 1 shows a schematic illustration of a processing system for a vapour refrigeration process. In the lower part of FIG. 1, there is illustrated a low-pressure circuit in which a fluid, carbon dioxide in the illustrated exemplary embodiment, coming from an accumulator S through an injector valve TV reaches a motor-operated main compressor C1 via an evaporator V. The fluid compressed by the main compressor C1 mixes with an intermediate pressure mass flow of the fluid that was compressed by a high pressure compressor C2 before the high pressure heat exchanger H in which a pressure higher than that in the accumulator S is maintained. From the high pressure heat exchanger H, the fluid arrives back in the accumulator S via a sub-cooler U and the expander E.

In the case of the illustrated processing system however, a separate intermediate pressure mass flow is compressed by the high pressure compressor C2 which is driven directly by the expander E before it arrives in the high pressure heat exchanger H. The high pressure compressor C2 only compresses this intermediate pressure mass flow, i.e. no fluid which is fed apart from the intermediate pressure mass flow. After the high pressure heat exchanger H, which is also referred to as a gas cooler or condenser, the fluid flowing straight out of the high pressure heat exchanger H and into a sub-cooler U located between the high pressure heat exchanger H and the expander E is subdivided after going through the sub-cooler U. A smaller part, typically between 15 percent and 30 percent, is throttle-expanded in a throttle TH which is also referred to as a high pressure regulating valve. Subsequently, the branched-off fluid absorbs heat in the counter-flow arrangement in the sub-cooler U and arrives at the high pressure compressor C2. The high pressure mass flow of the fluid is additionally subcooled thereby. The energy of the expansion process is thus used for the additional subcooling process at high pressure. Finally, the intermediate pressure mass flow that has been compressed back to high pressure by the high pressure compressor C2 is added to the fluid coming from the main compressor C1 before the high pressure heat exchanger H. Moreover, due to the branching process effected by the high pressure regulating valve TH directly before the expander E, there is a reduction of unwanted pulsations in the "liquid part" at the high pressure level and, in comparison with the known process of branching between the high pressure heat exchanger H and the sub-cooler U, this has further energy-related advantages in some operating points.

Hereby, a pressure difference and a suction flow rate can be freely set at the high pressure compressor C2 in accord with a supply on the expander side. If the high pressure regulating valve or the throttle TH is closed, the pressure difference thereof rises until the outlined expander-compressor unit stops and there is no longer any expander mass flow. The consequence of this is a rising high pressure. If the high pressure regulating valve TH is now slowly opened, the intermediate pressure rises again until the expander E runs and the desired expander mass flow, high pressure and expander inlet temperature reset. Hereby however, the high pressure should only be increased to an extent such that a minimum temperature difference remains on the "hot side" of the sub-cooler U, i.e. the high pressure-compressor-side. This is a further regulation principle. The expander mass flow is thus regulated without throttling it, something that would be equivalent to an energy loss.

The accumulator pressure in the accumulator S is selected to be only so high as to ensure adequate controllability of the injector valve TV and a pressure retaining valve TS which is arranged in a line that is connected between a vapour space of the accumulator S and after the evaporator V as well as before the main compressor C1. With constant evaporator pressure, this permits a constantly low accumulator pressure, independently of the high pressure.

With the aid of an apparatus and a corresponding method such as is illustrated in the exemplary embodiment in FIG. 1, the performance figure in the case of a −10° C. evaporation temperature and a 20° C. ambient temperature can be increased by approx. 15 percent in comparison with a simple vapour refrigeration process in which merely a compressor, a high pressure gas cooler or condenser, a throttle valve, an accumulator and an evaporator are made use of in known manner. The high pressure remains at comparable values hereby. In order to obtain an even bigger increase, further energy losses can be reduced by means of a two-stage compression process with intervening cooling, whereby the remaining procedural steps and the rest of the construction remain the same.

Moreover, it is possible to implement the expander E as a multi-stage device i.e. to let the expansion of the fluid occur in several stages. For this purpose for example, a plurality of individual expanders E can be arranged one behind the other. The construction known from DE 102 42 271 B3 without a frequency control system is suitable for this purpose.

Figure 2:
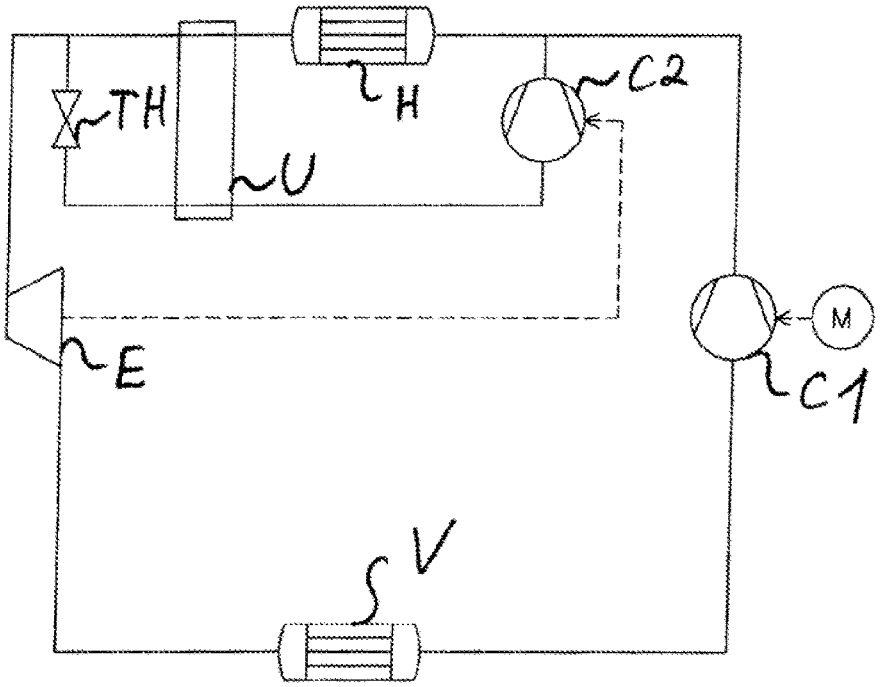

In a view corresponding to FIG. 1, FIG. 2 shows the described processing system without the accumulator S. Repeating features are provided in this Figure and also in the following Figures with identical reference symbols. The expander E thus feeds the fluid directly to the evaporator V without the fluid having passed through the accumulator S beforehand. In correspondence therewith, the injection valve TV and the pressure retaining valve TS are also obsolete.

Figure 3:
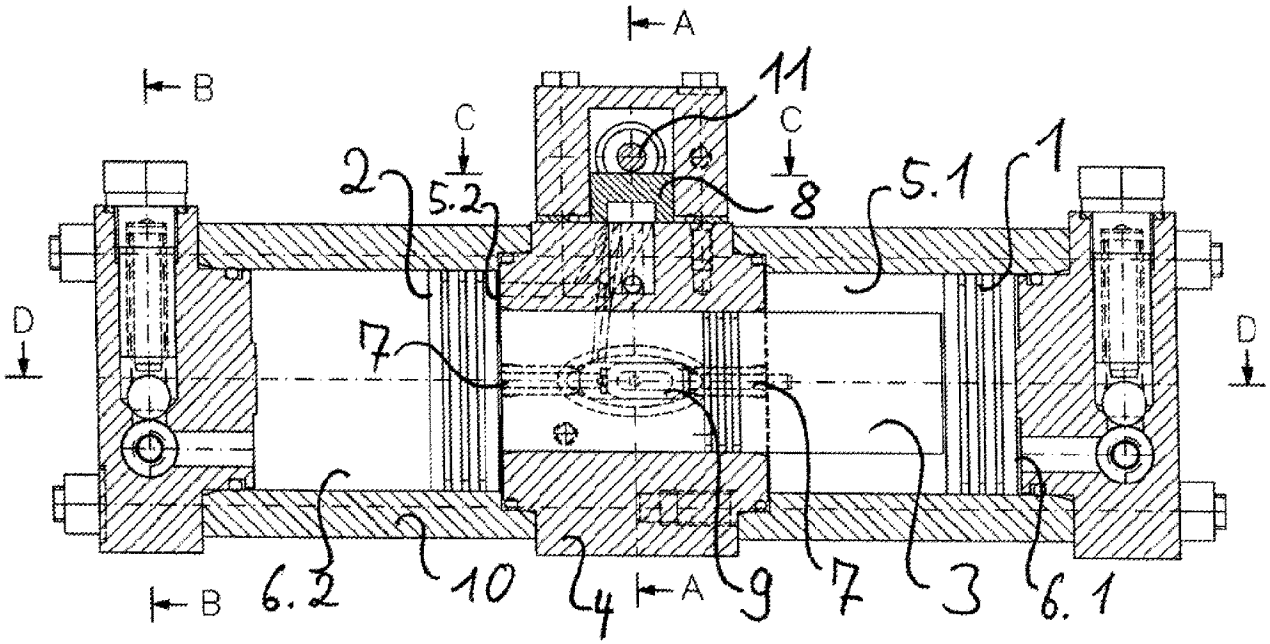
FIG. 3 a cross sectional view of an expander-compressor unit.

FIG. 3 shows in the form of a side view a cross section through an expander-compressor unit consisting of the expander E and the high pressure compressor C2 which are arranged in a common housing 10 and thus form the expander-compressor unit. Two pistons 1 and 2 are held apart by a piston rod 3 and are spatially separated from one another by a central section 4 of the unit. A plurality of work spaces are thereby formed, of which however only the work spaces 5.1 and 6.2 having a maximum work space are to be seen in the illustrated example. The work space 5.1 and also the work space 5.2 respectively form one of two expander work spaces, whilst the work spaces 6.1 and 6.2 each form one of two compressor work spaces. A value of between 0.5 and 0.75 has turned out to be an optimal piston displacement ratio of the illustrated unit.

In the illustrated exemplary embodiment, the internally located expander work spaces 5.1 and 5.2 are controlled by an auxiliary slide valve 9 arranged in the central section 4 and a main slide valve 8. Hereby, the auxiliary slide valve 9 is moved directly by the working pistons 1 and 2 by means of pins 7. The auxiliary slide valve 9 applies pressure to the main slide valve 8 in alternating manner and the latter thereby moves and controls an inlet opening and an outlet opening for the work spaces 5.1 and 5.2 of the expander E by means of an opening and a closing process. Hereby, the main slide valve 8 and the auxiliary slide valve 9 are advantageously implemented as flat slide valves.

Figure 4:
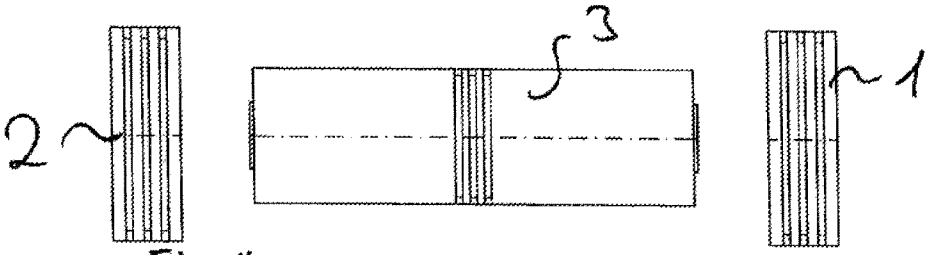
FIG. 4 a side view of a piston rod including working pistons.

Simple ball valves are arranged in the compressor work spaces 6.1 and 6.2. Since the piston rod 3 only experiences thrust forces in the illustrated exemplary embodiment, the piston rod 3 is not fixed to, but is connected releasably to the pistons 1 and 2 in that the pistons 1 and 2 only contact the piston rod 3 on the end face or flat surface thereof. This is shown in FIG. 4 in the form of a side view in which the working pistons 1 and 2 are separated from the piston rod 3. Naturally however, a fixed connection could also be provided in other exemplary embodiments. The illustrated construction thus also permits of the use of O-rings at locations which can otherwise only be sealed with difficulty.

Figure 5:
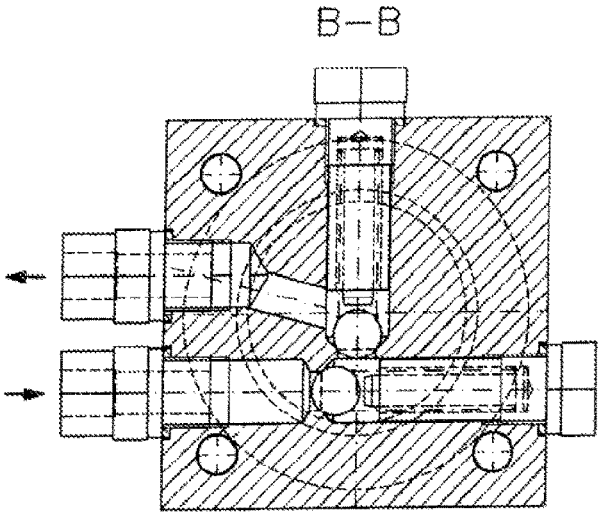
FIG. 5 a sectional view through an end of the expander-compressor unit.

FIG. 5 represents a sectional view along the line B-B of FIG. 3 through an end piece of the expander-compressor unit. A compressor valve in the form of a ball valve is connected by an upper connector to the high pressure side and by a lower connector thereof to the intermediate pressure level of the sub-cooler U.

Figure 6:
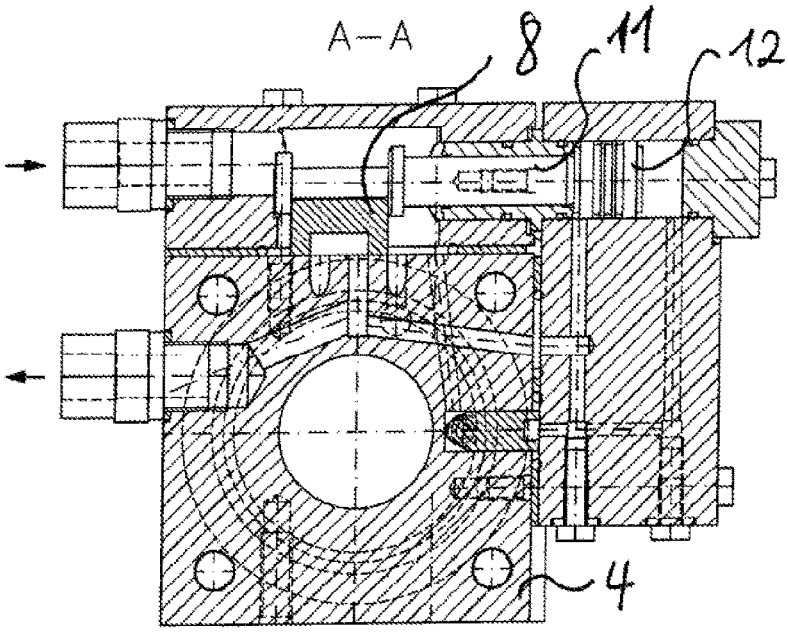
FIG. 6 a sectional view of a central section of the expander-compressor unit shown in FIG. 3.
Figure 7:
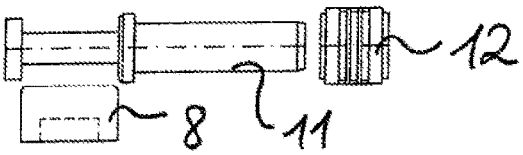
FIG. 7 a side view corresponding to FIG. 4 of the main slide valve including a slide valve rod and pistons.

A sectional view of the central section 4 of the expander-compressor unit shown in FIG. 3 is illustrated along the line A-A in FIG. 6. An upper connector feeds the fluid from the high pressure level of the sub-cooler U, whilst the lower connector leads to the accumulator S. The main slide valve 8 is connected by a slide valve rod 11 to a slide valve piston 12, wherein this connection is releasable. This is also illustrated in a side view in FIG. 7, wherein the main slide valve 8, the slide valve rod 11 and the slide valve piston 12 are illustrated as separate and mutually separated components.

Figure 8:
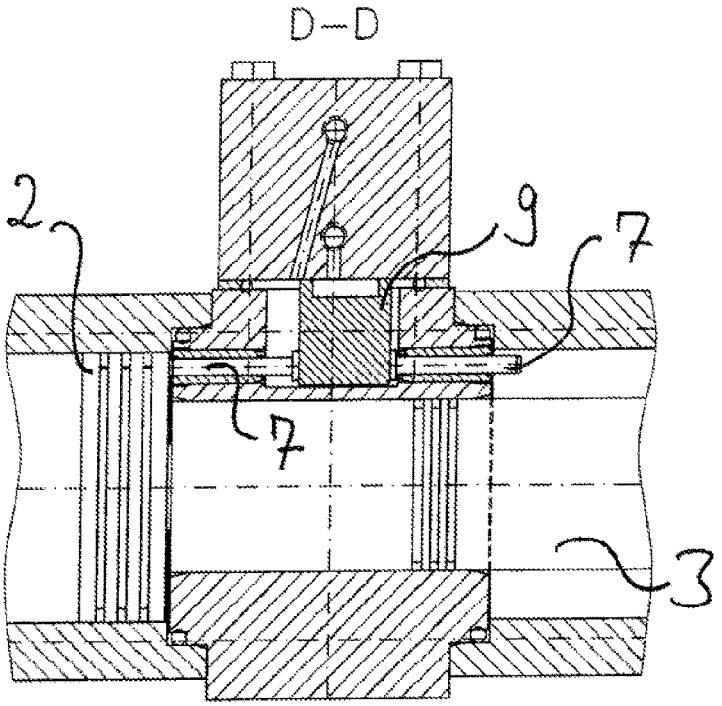
FIG. 8 an enlarged view of the auxiliary slide valve including pins.
Figure 9:
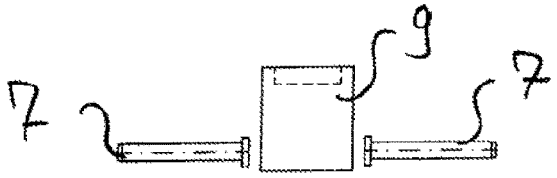
FIG. 9 a view corresponding to FIG. 4 of an auxiliary slide valve including pins.

The auxiliary slide valve 9 including the pins 7 employed for actuating it by the working pistons 1 and 2 is shown in FIG. 8 along the line D-D depicted in FIG. 3. FIG. 9 shows, in separated manner, in a view corresponding to FIG. 4, the auxiliary slide valve 9 and the two pins 7 by means of which the auxiliary slide valve 9 can be moved.

Figure 10:
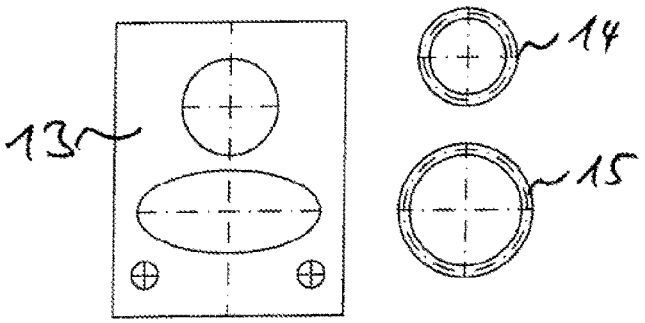
FIG. 10 a plan view of a sealing framework including O-rings.
Figure 11:
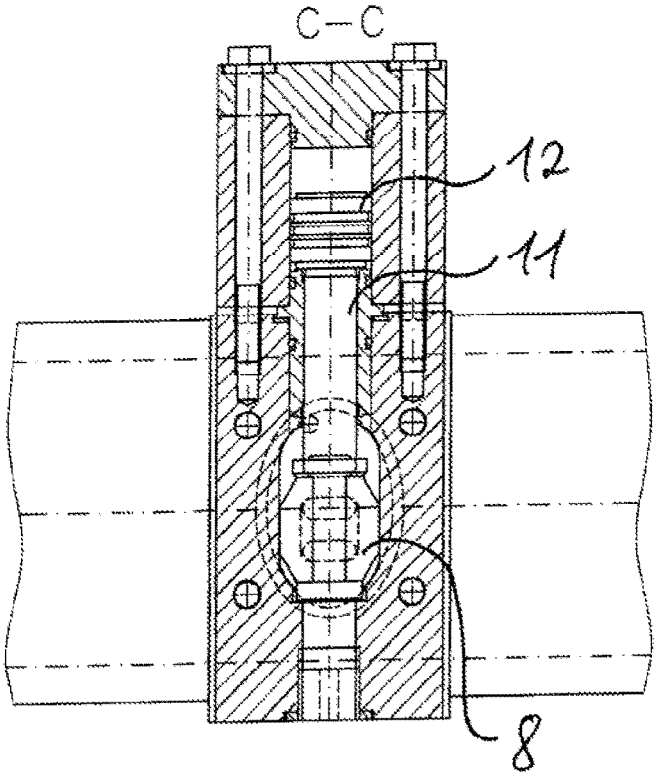
FIG. 11 an enlarged view of the main slide valve in plan view.
Figure 12:
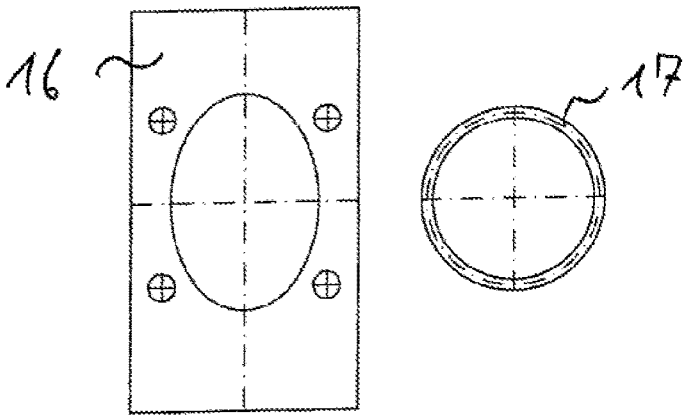
FIG. 12 a plan view of a further sealing framework including O-ring.

FIG. 10 shows in plan view a sealing framework 13 with two O-rings 14 and 15 for the auxiliary slide valve 9 which, when installed, are arranged in break-throughs of the sealing framework 13. The main slide valve 8 including the slide valve rod 11 and the slide valve piston 12 are illustrated in FIG. 11 in the form of a plan view along the line C-C depicted in FIG. 3. In a similar manner to FIG. 10, FIG. 12 shows a further sealing framework 16 with an O-ring 17 for the main slide valve 8. The construction described immediately permits the use of O-rings at surfaces which can only be sealed with difficulty (namely, around the main slide valve 8 and the auxiliary slide valve 9) so that pocket milling through corresponding support frames is avoided.

The invention claimed is:

1. Apparatus for carrying out a vapour refrigeration process comprising a motor-operated main compressor which is equipped to suck in a mass flow of a fluid which serves as a refrigerant and is at evaporating pressure level and to compress this mass flow to a high pressure level, a high pressure heat exchanger which is equipped to cool the mass flow of the fluid that is at a high pressure level, to increase a density and to reduce a temperature of the fluid, an expander which is equipped to expand the mass flow of the fluid coming from the high pressure heat exchanger to the evaporating pressure level in work-performing manner, an evaporator which is equipped to absorb heat so that the density of the fluid when going through the evaporator decreases and the temperature of the mass flow coming from the expander at evaporating pressure level and the temperature of the fluid being fed through the evaporator increase, a sub-cooler which is connected downstream of the high pressure heat exchanger and upstream of the expander, wherein a part of the mass flow of the fluid which is at a high pressure level is arranged to be branched off after the sub-cooler and before the expander and to be expanded by means of a high pressure regulating valve to an intermediate pressure level so that the fluid which is then at intermediate pressure level absorbs heat in a counter-flow arrangement in the sub-cooler and thereby subcools the mass flow which is at high pressure level, a high pressure compressor which is mechanically connected directly to the expander and is equipped to compress exclusively the mass flow of the fluid at intermediate pressure level which was branched off before the expander and is flowing counter to the mass flow of the fluid at high pressure level which is being fed through the sub-cooler and to mix it before the high pressure heat exchanger (H) with the mass flow coming from the motor-operated main compressor.

2. An apparatus in accordance with claim 1, wherein, after the expander, there is arranged an accumulator which is equipped to separate a liquid phase of the fluid and a vapour phase of the fluid, wherein the liquid phase is storable, expandable to the pressure of evaporation by an injector valve and the vapour phase of the fluid is expandable by a pressure retaining valve, wherein the expanded liquid phase is arranged to be supplied to the evaporator and the expanded vapour phase is mixable after the evaporator into the mass flow of the fluid coming from the evaporator.

3. An apparatus in accordance with claim 1, wherein the expander and the high pressure compressor are arranged in a common housing.

4. An apparatus in accordance with claim 1, wherein a piston displacement ratio between the expander and the high pressure compressor is maintained between 0.5 and 0.75.

5. An apparatus in accordance with claim 1, wherein work spaces of the expander are controllable by a main slide valve and an auxiliary slide valve which are arranged centrally between the work spaces.

6. An apparatus in accordance with claim 5, wherein the main slide valve and/or the auxiliary slide valve is/are in the form of flat slide valves.

7. An apparatus in accordance with claim 5, wherein the auxiliary slide valve is movable by working pistons by means of at least two pins.

8. An apparatus in accordance with claim 7, wherein a piston rod is connected to the working pistons in releasable manner.

9. Method for carrying out a vapour refrigeration process, in which a mass flow of a fluid which is at evaporating pressure level and serves as a refrigerant is sucked in by a motor-operated main compressor and compressed to a high pressure level, the mass flow of the fluid which is at a high pressure level is cooled in a high pressure heat exchanger, whereby a density is increased and a temperature of the fluid is reduced, the fluid coming from the high pressure heat exchanger is expanded in an expander in work-performing manner to evaporating pressure level, wherein the expander is mechanically connected directly to a high pressure compressor, the fluid coming from the expander is fed to an evaporator and absorbs heat so that the density decreases and the temperature of the mass flow coming from the expander which is at evaporating pressure level increases, wherein, after the high pressure heat exchanger, the fluid is fed through a sub-cooler and a part of the fluid is branched off between the sub-cooler and before the expander from the mass flow which is at the high pressure level and is being fed through the sub-cooler and is expanded to an intermediate pressure level by means of a high pressure regulating valve, thereafter, in the sub-cooler is fed in counter-flow to the mass flow at high pressure level that is flowing therethrough, absorbs heat and the mass flow which is at high pressure level is thereby subcooled, and, after passing through the sub-cooler, passes through the high pressure compressor, whereby exclusively the fluid being fed in counter-flow is compressed by the high pressure compressor to high pressure level and, before the high pressure heat exchanger, is mixed with the mass flow coming from the motor-operated main compressor.

10. A method in accordance with claim 9, wherein, after the expander, the fluid is fed into an accumulator in which a liquid phase of the fluid is separated from a vapour phase of the fluid and the liquid phase is expanded to the pressure of evaporation by an injector valve and the vapour phase of the fluid is expanded by a pressure retaining valve and, after the evaporator, is mixed with the mass flow of the fluid coming from the evaporator.

11. A method in accordance with claim 9, wherein carbon dioxide is used as the fluid.

* * * * *